US012318053B2

(12) United States Patent
Aguiar, Jr. et al.

(10) Patent No.: US 12,318,053 B2
(45) Date of Patent: Jun. 3, 2025

(54) DISHWASHING APPLIANCE AUDIO MONITORING

(71) Applicant: Haier US Appliance Solutions, Inc., Wilmington, DE (US)

(72) Inventors: Ricardo Alberto Aguiar, Jr., Clarksville, IN (US); Maegan Gail Williams, Louisville, KY (US); Brett Alan Farris, Louisville, KY (US)

(73) Assignee: Haier US Appliance Solutions, Inc., Wilmington, DE (US)

( * ) Notice: Subject to any disclaimer, the term of this patent is extended or adjusted under 35 U.S.C. 154(b) by 190 days.

(21) Appl. No.: 17/962,002

(22) Filed: Oct. 7, 2022

(65) Prior Publication Data

US 2024/0115109 A1 Apr. 11, 2024

(51) Int. Cl.
*A47L 15/42* (2006.01)
*A47L 15/00* (2006.01)

(52) U.S. Cl.
CPC ..... *A47L 15/4246* (2013.01); *A47L 15/0063* (2013.01); *A47L 2501/26* (2013.01)

(58) Field of Classification Search
None
See application file for complete search history.

(56) References Cited

U.S. PATENT DOCUMENTS 3,809,851 A * 5/1974 Aeschlimann ..... D06F 71/34 219/243
9,386,140 B2 7/2016 Logan et al.
10,934,654 B1 3/2021 Farris et al.

FOREIGN PATENT DOCUMENTS

CN 111557626 A 8/2020
DE 10204455 A1 8/2003
DE 102015102694 A1 8/2016
JP 2013223563 A 10/2013

OTHER PUBLICATIONS

DE10204455 A1 translation, Method For Monitoring Integrity Of Dishwashing Machine Component Parts Has Number Of Acoustic Sensors And Memory Of Reference Sound Levels, Asmann (Year: 2003).*

* cited by examiner

*Primary Examiner* — Cristi J Tate-Sims
(74) *Attorney, Agent, or Firm* — Dority & Manning, P.A.

(57) ABSTRACT

A dishwashing appliance includes a tub defining a wash chamber therein for receipt of articles for washing. A method of operating the dishwashing appliance includes initiating a cycle of the dishwashing appliance. The method also includes, during the cycle of the dishwashing appliance, monitoring audio feedback from a component of the dishwashing appliance using a microphone mounted to the dishwashing appliance outside of the wash chamber.

18 Claims, 7 Drawing Sheets

DISHWASHING APPLIANCE AUDIO MONITORING

FIELD OF THE INVENTION

The present subject matter relates generally to dishwashing appliances, and more particularly to features and methods for using audio to monitor the status of components of dishwashing appliances.

BACKGROUND OF THE INVENTION

Dishwashing appliances generally include a tub that defines a wash chamber. Rack assemblies can be mounted within the wash chamber of the tub for receipt of articles for washing. Multiple spray assemblies can be positioned within the wash chamber for applying or directing wash liquid (e.g., water, detergent, etc.) towards articles disposed within the rack assemblies in order to clean such articles. Dishwashing appliances are also typically equipped with one or more pumps, such as a circulation pump or a drain pump, for directing or motivating wash liquid from the sump to, e.g., the spray assemblies or an area outside of the dishwashing appliance.

Various cycles may be included as part of the overall cleaning process. For example, a typical, user-selected cleaning option may include a wash cycle and rinse cycle (referred to collectively as a wet cycle), as well as a drying cycle. During such cycles, various components of the dishwashing appliance are activated and deactivated, typically in a predetermined sequence and for predetermined durations. However, when one or more components is not activated when expected or does not remain on for the expected duration, the performance of the cycle may be adversely impacted, for example, dishes in the dishwashing appliance may not get as clean as desired.

Accordingly, features and methods for monitoring the status of one or more components, such as detecting activation and/or deactivation thereof, in a dishwashing appliance during a cycle of the dishwashing appliance would be useful.

BRIEF DESCRIPTION OF THE INVENTION

Aspects and advantages of the invention will be set forth in part in the following description, or may be obvious from the description, or may be learned through practice of the invention.

In one exemplary aspect of the present disclosure, a method of operating a dishwashing appliance is provided. The dishwashing appliance includes a tub defining a wash chamber therein for receipt of articles for washing. The method includes initiating a cycle of the dishwashing appliance. The method also includes monitoring, during the cycle of the dishwashing appliance, audio feedback from a component of the dishwashing appliance using a microphone mounted to the dishwashing appliance outside of the wash chamber.

In another exemplary aspect of the present disclosure, a dishwashing appliance is provided. The dishwashing appliance includes a tub defining a wash chamber therein for receipt of articles for washing and a microphone mounted to the dishwashing appliance outside of the wash chamber. The dishwashing appliance also includes a controller. The controller is configured for initiating a cycle of the dishwashing appliance. The controller is also configured for monitoring, during the cycle of the dishwashing appliance, audio feedback from a component of the dishwashing appliance using the microphone.

These and other features, aspects and advantages of the present invention will become better understood with reference to the following description and appended claims. The accompanying drawings, which are incorporated in and constitute a part of this specification, illustrate embodiments of the invention and, together with the description, serve to explain the principles of the invention.

BRIEF DESCRIPTION OF THE DRAWINGS

A full and enabling disclosure of the present invention, including the best mode thereof, directed to one of ordinary skill in the art, is set forth in the specification, which makes reference to the appended figures.

DETAILED DESCRIPTION

Figure 1:
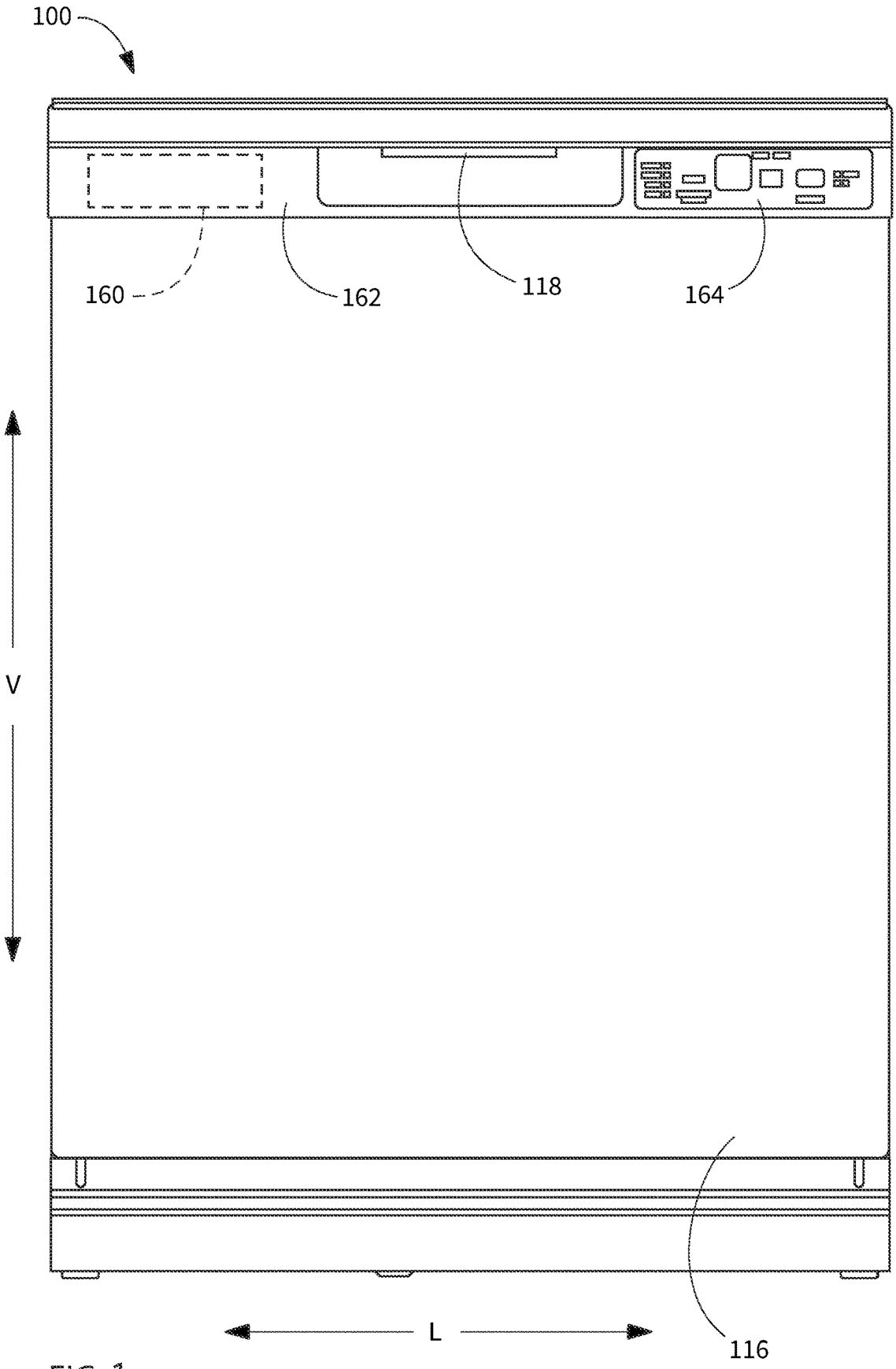
FIG. 1 provides a front view of an exemplary embodiment of a dishwashing appliance of the present disclosure.

Reference now will be made in detail to embodiments of the invention, one or more examples of which are illustrated in the drawings. The detailed description uses numerical and letter designations to refer to features in the drawings. Like or similar designations in the drawings and description have been used to refer to like or similar parts of the disclosure. Each example is provided by way of explanation of the invention, not limitation of the invention. In fact, it will be apparent to those skilled in the art that various modifications and variations can be made in the present invention without departing from the scope of the invention. For instance, features illustrated or described as part of one embodiment can be used with another embodiment to yield a still further embodiment. Thus, it is intended that the present invention covers such modifications and variations as come within the scope of the appended claims and their equivalents.

As used herein, the term "or" is generally intended to be inclusive (i.e., "A or B" is intended to mean "A or B or both"). The terms "first," "second," and "third" may be used interchangeably to distinguish one component from another and are not intended to signify location or importance of the individual components. The terms "upstream" and "downstream" refer to the relative flow direction with respect to fluid flow in a fluid pathway. For instance, "upstream" refers to the flow direction from which the fluid flows, and "downstream" refers to the flow direction to which the fluid flows. The term "article" may refer to, but need not be limited to dishes, pots, pans, silverware, and other cooking utensils and items that can be cleaned in a dishwashing appliance. The term "wash cycle" is used to refer to an overall operation of the dishwashing appliance which may include two or more distinct phases. The term "wash phase" is intended to refer to one or more periods of time during which a dishwashing appliance operates while containing the articles to be washed and uses a wash liquid (e.g., water, detergent, or wash additive) and may be a portion of the wash cycle, such as a beginning or early portion of the wash cycle. The term "rinse phase" is intended to refer to one or more periods of time during which the dishwashing appliance operates to remove residual soil, detergents, and other undesirable elements that were retained by the articles after completion of the wash phase and may be a portion of the wash cycle, such as an intermediate portion of the wash cycle. The term "drain phase" is intended to refer to one or more periods of time during which the dishwashing appliance operates to discharge soiled water from the dishwashing appliance and may be a portion of the wash cycle, such as a later portion of the wash cycle. The term "wash liquid" refers to a liquid used for washing or rinsing the articles that is typically made up of water and may include additives, such as detergent or other treatments (e.g., rinse aid). Furthermore, as used herein, terms of approximation, such as "generally," "approximately," "substantially," or "about," refer to being within a ten percent (10%) margin of error. When used in the context of an angle or direction, such terms include within ten degrees greater or less than the stated angle or direction, e.g., "generally vertical" includes forming an angle of up to ten degrees in any direction, e.g., clockwise or counterclockwise, with the vertical direction V.

Figure 2:
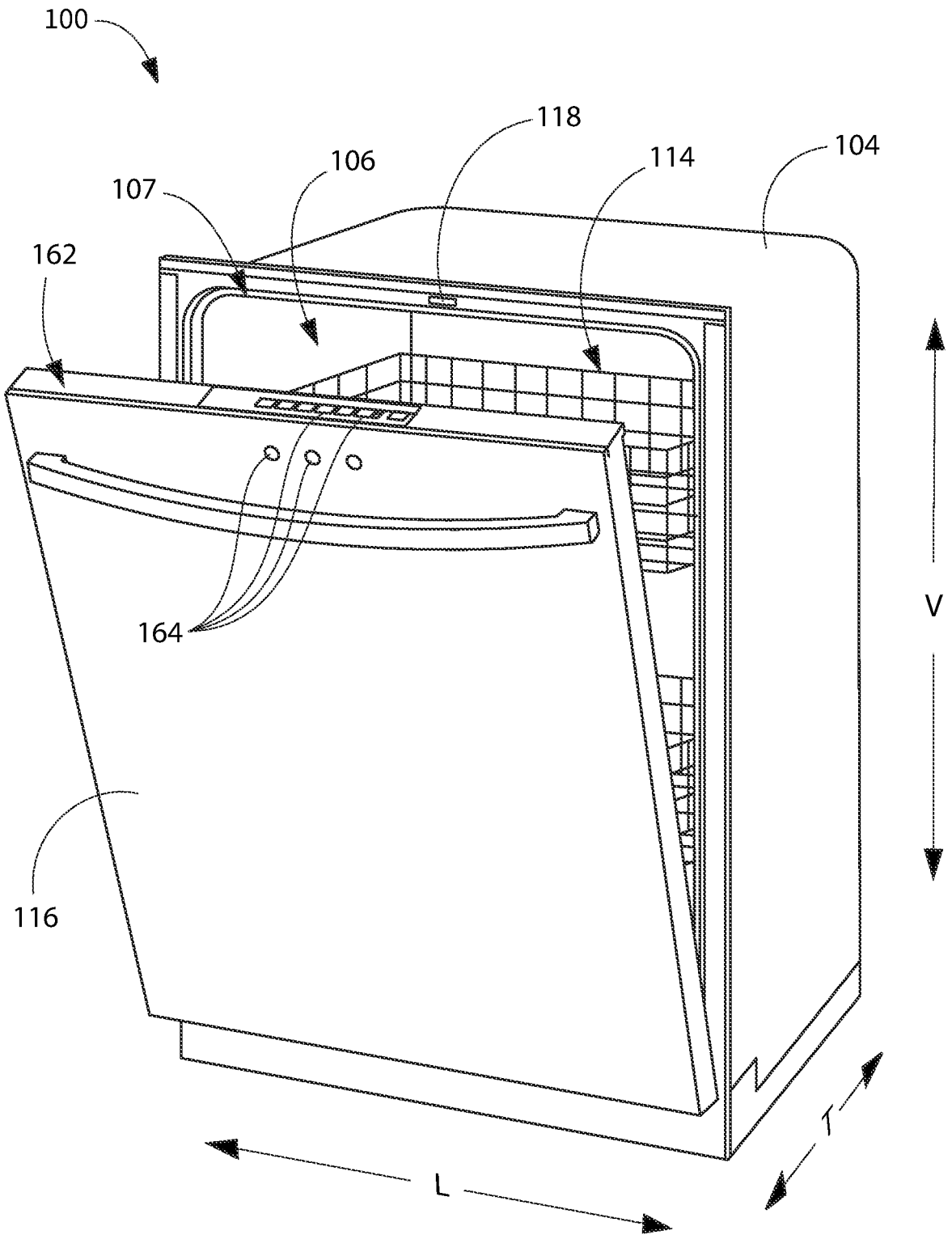
FIG. 2 provides a perspective view of an additional exemplary embodiment of a dishwashing appliance of the present disclosure with a door in an intermediate position.
Figure 3:
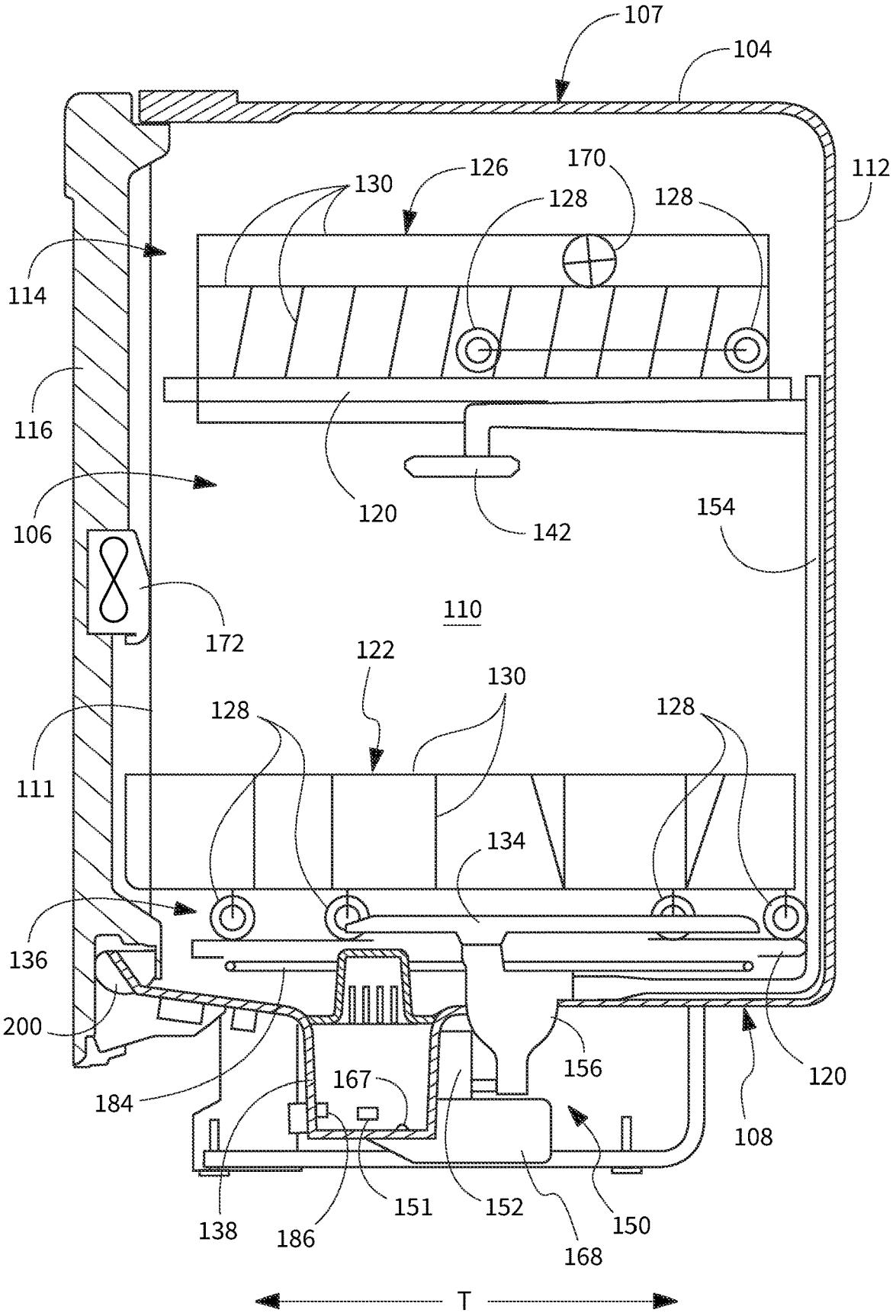
FIG. 3 provides a side, cross section view of an exemplary dishwashing appliance, such as the dishwashing appliance of FIG. 1 or FIG. 2.

Turning now to the figures, FIGS. 1 through 3 depict an exemplary dishwasher or dishwashing appliance (e.g., dishwashing appliance 100) that may be configured in accordance with aspects of the present disclosure. Generally, dishwasher 100 defines a vertical direction V, a lateral direction L, and a transverse direction T. Each of the vertical direction V, lateral direction L, and transverse direction T are mutually perpendicular to one another and form an orthogonal direction system.

Dishwasher 100 includes a tub 104 that defines a wash chamber 106 therein. As shown in FIG. 3, tub 104 extends between a top 107 and a bottom 108 along the vertical direction V, between a pair of side walls 110 along the lateral direction L, and between a front side 111 and a rear side 112 along the transverse direction T.

Tub 104 includes a front opening 114 at the front side 111. In some embodiments, the dishwashing appliance 100 may also include a door 116 at the front opening 114. The door 116 may, for example, be coupled to the tub 104 by a hinge 200 at its bottom for movement between a normally closed vertical position (FIGS. 1 and 3), wherein the wash chamber 106 is sealed shut for washing operation, and a horizontal open position (not shown) for loading and unloading of articles from dishwasher 100. A door closure mechanism or assembly 118, e.g., a latch, may be provided to lock and unlock door 116 for accessing and sealing wash chamber 106.

In exemplary embodiments, tub side walls 110 accommodate a plurality of rack assemblies. For instance, guide rails 120 may be mounted to side walls 110 for supporting a lower rack assembly 122 and an upper rack assembly 126. In some such embodiments, upper rack assembly 126 is positioned at a top portion of wash chamber 106 above lower rack assembly 122 along the vertical direction V.

Generally, each rack assembly 122, 126 may be adapted for movement between an extended loading position (not shown) in which the rack is substantially positioned outside the wash chamber 106, and a retracted position (shown in FIGS. 1 through 3) in which the rack is located inside the wash chamber 106. In some embodiments, movement is facilitated, for instance, by rollers 128 mounted onto rack assemblies 122, 126, respectively.

Although guide rails 120 and rollers 128 are illustrated herein as facilitating movement of the respective rack assemblies 122, 126, it should be appreciated that any suitable sliding mechanism or member may be used according to alternative embodiments.

In optional embodiments, some or all of the rack assemblies 122, 126 are fabricated into lattice structures including a plurality of wires or elongated members 130 (for clarity of illustration, not all elongated members making up rack assemblies 122, 126 are shown). In this regard, rack assemblies 122, 126 are generally configured for supporting articles within wash chamber 106 while allowing a flow of wash liquid to reach and impinge on those articles (e.g., during a cleaning or rinsing phase of the wash cycle). According to additional or alternative embodiments, a silverware basket (not shown) may be removably attached to a rack assembly (e.g., lower rack assembly 122), for placement of silverware, utensils, and the like, that are otherwise too small to be accommodated by the rack assembly.

Generally, dishwasher 100 includes one or more spray assemblies for urging a flow of fluid (e.g., wash liquid) onto the articles placed within wash chamber 106.

In exemplary embodiments, dishwasher 100 includes a lower spray arm assembly 134 disposed in a lower region 136 of wash chamber 106 and above a sump 138 so as to rotate in relatively close proximity to lower rack assembly 122. In this regard, lower spray arm assembly 134 may generally be configured for urging a flow of wash liquid up through lower rack assembly 122.

In some embodiments, an upper spray assembly 142 may be located proximate to and, e.g., below, upper rack assembly 126 along the vertical direction V. In this manner, upper spray assembly 142 may be generally configured for urging of wash liquid up through upper rack assembly 126.

The various spray assemblies and manifolds described herein may be part of a fluid distribution system or fluid circulation assembly 150 for circulating wash liquid in tub 104. In certain embodiments, fluid circulation assembly 150 includes a circulation pump 152 for circulating wash liquid in tub 104. Circulation pump 152 may be mounted to sump 138 and in fluid communication with the sump 138 through a circulation outlet 151 from the sump 138.

When assembled, circulation pump 152 may be in fluid communication with an external water supply line (not shown) and sump 138. A water inlet valve (not shown) can be positioned between the external water supply line and circulation pump 152 (e.g., to selectively allow water to flow from the external water supply line to circulation pump 152). Additionally or alternatively, water inlet valve can be positioned between the external water supply line and sump 138 (e.g., to selectively allow water to flow from the external water supply line to sump 138). During use, water inlet valve may be selectively controlled to open to allow the flow of water into dishwasher 100 and may be selectively controlled to close and thereby cease the flow of water into dishwasher 100. Further, fluid circulation assembly 150 may include one or more fluid conduits or circulation piping for directing wash fluid from circulation pump 152 to the various spray assemblies and manifolds. In exemplary embodiments, such as that shown in FIG. 3, a primary supply conduit 154 extends from circulation pump 152, along rear side 112 of tub 104 along the vertical direction V to supply wash liquid throughout wash chamber 106.

In optional embodiments, circulation pump 152 urges or pumps wash liquid to a diverter 156 (FIG. 3). In some such embodiments, diverter 156 is positioned within sump 138 of dishwashing appliance 100). Diverter 156 may include a diverter disk (not shown) disposed within a diverter chamber 158 for selectively distributing the wash liquid to the spray assemblies 134, 142, or other spray manifolds or assemblies. For instance, the diverter disk may have at least one aperture configured to align with one or more outlet ports (not shown) at the top of diverter chamber 158. In this manner, the diverter disk may be selectively rotated to provide wash liquid to the desired spray device(s).

In exemplary embodiments, diverter 156 is configured for selectively distributing the flow of wash liquid from circulation pump 152 to various fluid supply conduits—only some of which are illustrated in FIG. 3 for clarity. In certain embodiments, diverter 156 includes two or more outlet ports (not shown) for supplying wash liquid to a first conduit for rotating lower spray arm assembly 134 and a second conduit for supplying upper spray assembly 142 (e.g., supply conduit 154). Additional embodiments may also include one or more additional conduits, e.g., a third conduit for spraying an auxiliary rack such as a silverware rack, etc.

In some embodiments, a supply conduit 154 is used to supply wash liquid to one or more spray assemblies (e.g., to upper spray assembly 142). It should be appreciated, however, that according to alternative embodiments, any other suitable plumbing configuration may be used to supply wash liquid throughout the various spray manifolds and assemblies described herein. For instance, according to another exemplary embodiment, supply conduit 154 could be used to provide wash liquid to lower spray arm assembly 134 and a dedicated secondary supply conduit (not shown) could be utilized to provide wash liquid to upper spray assembly 142. Other plumbing configurations may be used for providing wash liquid to the various spray devices and manifolds at any location within dishwashing appliance 100.

Each spray assembly 134 and 142, or other spray device as may be included in dishwashing appliance 100, may include an arrangement of discharge ports or orifices for directing wash liquid received from circulation pump 152 onto dishes or other articles located in wash chamber 106. The arrangement of the discharge ports, also referred to as jets, apertures, or orifices, may provide a rotational force by virtue of wash liquid flowing through the discharge ports. Alternatively, spray assemblies 134, 142 may be motor-driven, or may operate using any other suitable drive mechanism. Spray manifolds and assemblies may also be stationary. The resultant movement of the spray assemblies 134, 142 and the spray from fixed manifolds provides coverage of dishes and other dishwasher contents with a washing spray. Other configurations of spray assemblies may be used as well. For instance, dishwasher 100 may have additional spray assemblies for cleaning silverware, for scouring casserole dishes, for spraying pots and pans, for cleaning bottles, etc.

Drainage of soiled wash liquid within sump 138 may by provided, for instance, by a drain pump 168 (e.g., during or as part of a drain phase). In particular, wash liquid may exit sump 138 through a drain outlet 167 and may flow through a drain conduit or directly to the drain pump 168. Thus, drain pump 168 is downstream of sump 138 and facilitates drainage of the soiled wash liquid by urging or pumping the wash liquid to a drain line external to dishwasher 100.

In some embodiments, a filter assembly may be provided, e.g., in the sump 138 and/or at a top entrance into the sump 138, e.g., to filter fluid to circulation assembly 150 and/or drain pump 168. Generally, the filter assembly removes soiled particles from the liquid that flows to the sump 138 from the wash chamber 106 during operation of dishwashing appliance 100. In exemplary embodiments, the filter assembly may include both a first filter (also referred to as a "coarse filter") and a second filter (also referred to as a "fine filter").

Although a separate circulation pump 152 and drain pump 168 are described herein, it is understood that other suitable pump configurations (e.g., using only a single pump for both recirculation and draining) may be provided.

The dishwashing appliance 100 may further include a heating element 184, such as a resistance heating element, positioned in or near the sump 138. For example, the heating element 184 may be positioned "near" the sump 138 in that the heating element 184 is disposed above the sump 138 and within the lower region 136 of wash chamber 106, such as below the lower spray arm 134 and/or below the lower rack assembly 122. The heating element 184 may be positioned and configured to heat liquid in the sump 138, such as for a heated wash phase, and/or to heat air within the wash chamber 106, such as for drying articles during a dry phase.

Dishwashing appliance 100 may also include ventilation features, e.g., to promote improved, e.g., more rapid, drying of articles therein after the wash and rinse phases. For example, one or more vents 170 may be provided in the tub 104 for introducing relatively dry air from outside of the tub 104 into the wash chamber 106 and/or for removing relatively humid air from the wash chamber 106 to the outside of the tub 104. In some embodiments, a fan 172 may be provided. The fan 172 may be operable to urge air through the wash chamber 106, such as to promote air circulation and/or ventilation within and through the wash chamber. Such air movement may increase the rate of evaporation of moisture from articles in the wash chamber 106 after a wash and/or rinse phase.

In certain embodiments, dishwasher 100 includes a controller 160 configured to regulate operation of dishwasher 100 (e.g., initiate one or more wash operations). Controller 160 may include one or more memory devices and one or more microprocessors, such as general or special purpose microprocessors operable to execute programming instructions or micro-control code associated with a wash operation or wash cycle that may include a pre-wash phase, a wash phase, a rinse phase, a drain phase, and/or a dry phase. The memory may represent random access memory such as DRAM, or read only memory such as ROM or FLASH. In some embodiments, the processor executes programming instructions stored in memory. The memory may be a separate component from the processor or may be included onboard within the processor. Alternatively, controller 160 may be constructed without using a microprocessor, e.g., using a combination of discrete analog or digital logic circuitry—such as switches, amplifiers, integrators, comparators, flip-flops, AND gates, and the like—to perform control functionality instead of relying upon software. It should be noted that controllers as disclosed herein are capable of and may be operable to perform any methods and associated method steps as disclosed herein.

Controller 160 may be positioned in a variety of locations throughout dishwasher 100. In optional embodiments, controller 160 is located within a control panel area 162 of door 116 (e.g., as shown in FIG. 1 or FIG. 2). Input/output ("I/O") signals may be routed between the control system and various operational components of dishwasher 100 along wiring harnesses that may be routed through the bottom of door 116. Typically, the controller 160 includes or is operatively coupled to a user interface panel/controls 164 through which a user may select various operational features and modes and monitor progress of dishwasher 100. In some embodiments, user interface 164 includes a general purpose I/O ("GPIO") device or functional block. In additional or alternative embodiments, user interface 164 includes input components, such as one or more of a variety of electrical, mechanical or electro-mechanical input devices including rotary dials, push buttons, and touch pads. In further additional or alternative embodiments, user interface 164 includes a display component, such as a digital or analog display device designed to provide operational feedback to a user. When assembled, user interface 164 may be in operative communication with the controller 160 via one or more signal lines or shared communication busses.

The dishwashing appliance 100 may also include a temperature sensor 186 in operative communication with the controller 160. For example, in some embodiments, the temperature sensor 186 may be located in the sump 138 and may thereby be operable to measure a temperature of a liquid, e.g., wash liquid, within the sump 138. For example, the "temperature sensor" may include any suitable type of temperature measuring system or device positioned at any suitable location for measuring the desired temperature. Thus, for example, temperature sensor 186 may be any suitable type of temperature sensor, such as a thermistor, a thermocouple, a resistance temperature detector, a semiconductor-based integrated circuit temperature sensor, etc. In addition, temperature sensor 186 may be positioned at any suitable location and may output a signal, such as a voltage, to the controller 160 that is proportional to and/or indicative of the temperature being measured. Although exemplary positioning of the temperature sensor 186 is described herein and depicted in FIG. 3, it should be appreciated that dishwashing appliance 100 may include any other suitable number, type, and position of temperature, humidity, and/or other sensors as well as or instead of the exemplary temperature sensor 186 according to alternative embodiments.

It should be appreciated that the invention is not limited to any particular style, model, or configuration of dishwasher 100. The exemplary embodiments depicted in FIGS. 1 through 3 are for illustrative purposes only. For instance, different locations may be provided for control panel area 162 (e.g., on the front of the door 116 as illustrated in FIG. 1 or on the top of the door 116 as illustrated in FIG. 2, or other locations as well), different configurations may be provided for rack assemblies 122, 126, different spray assemblies 134, 142 and spray manifold configurations may be used, different sensors may be used, and other differences may be applied while remaining within the scope of the present disclosure.

Figure 4:
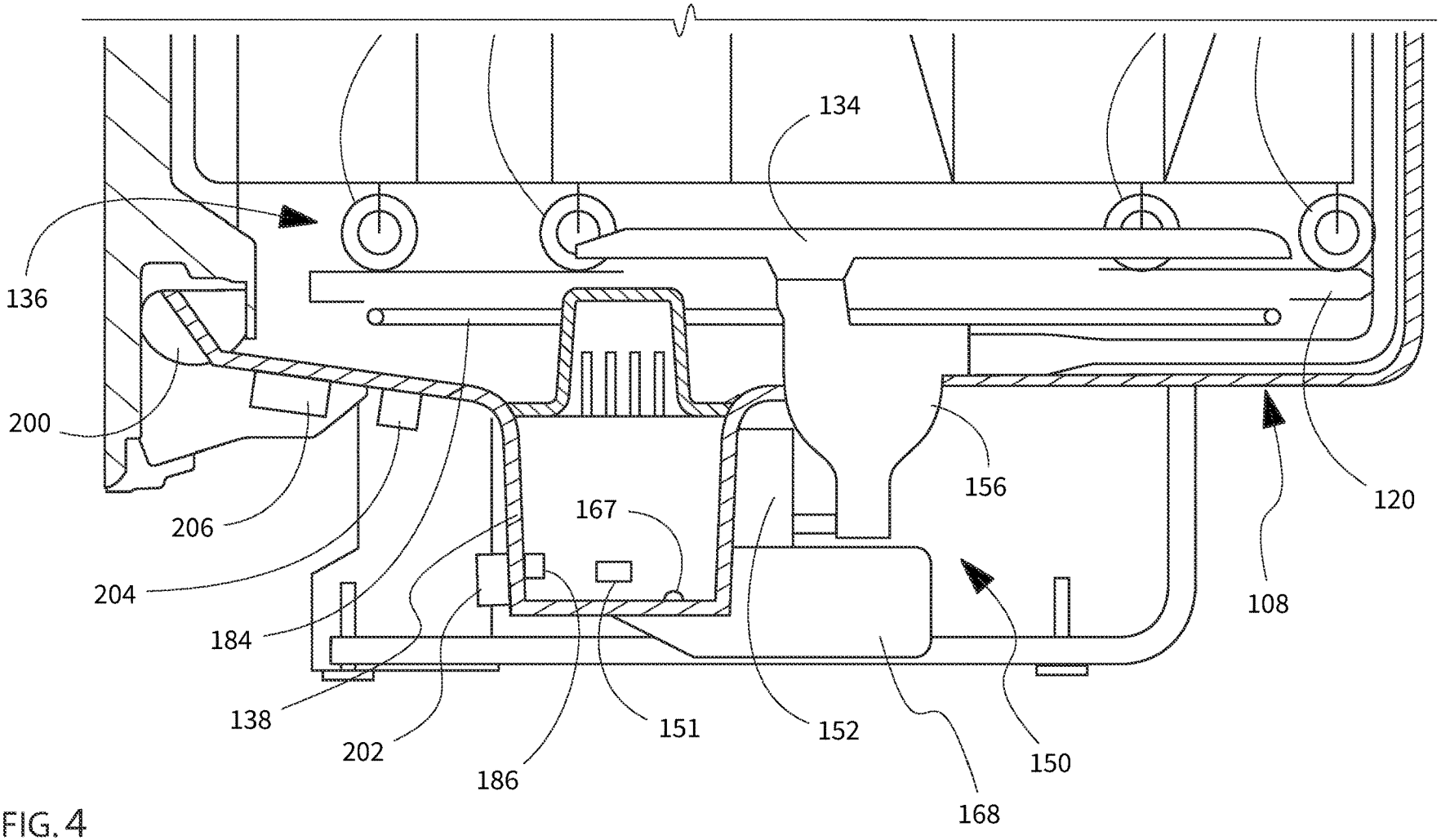
FIG. 4 provides an enlarged view of a portion of the exemplary dishwashing appliance of FIG. 3.

In some embodiments, e.g., as illustrated in FIG. 4, the dishwashing appliance 100 may include a microphone 202. The microphone 202 may be in communication with a controller, such as controller 160. The microphone 202 may be mounted to the dishwashing appliance 100 in any suitable location, such as outside of the wash chamber 106, e.g., on one of the walls of the tub 104, such as on an external surface (e.g., opposite the wash chamber 106) of the tub 104. For example, in some embodiments, such as the exemplary embodiment illustrated in FIG. 4, the microphone 202 may be mounted to the sump 138. The microphone 202 may be positioned near, such as in within detection range of the microphone 202, to one or more components of the dishwashing appliance 100, such as mechanical components, electrical components, and/or electromechanical components of the dishwashing appliance 100. In some embodiments, such components may be or include one or more electrical relays, such as a first electrical relay 204 and a second electrical relay 206. The electrical relays 204 and 206 may be coupled to various other components of the dishwashing appliance 100, such as the circulation pump 152, drain pump 168, or heating element 184. Those of ordinary skill in the art will recognize that the components, such as heating element 184, may be coupled to an electrical power supply via one or more electrical conduits, e.g., wires, wiring harnesses, etc., which are not specifically illustrated, and that the supply of electrical power to each component may be controlled by one or more electrical relays, such as the first relay 204 and the second relay 206. For example, when one or both relays are engaged, electrical power may be supplied to the respective other component, such as to activate the heating element 184 or the circulation pump 152, etc.

Figure 5:
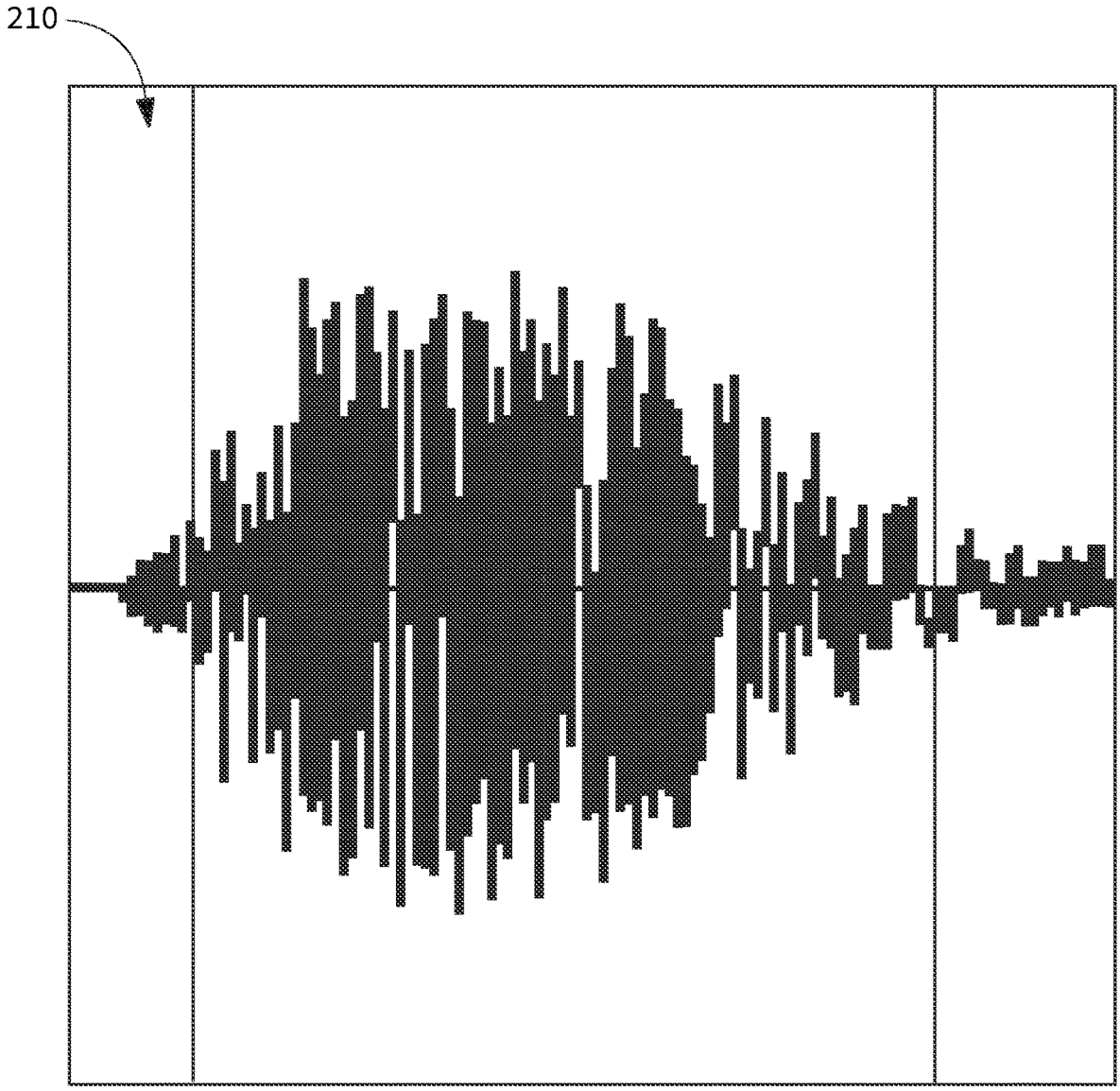
FIG. 5 illustrates an exemplary graph of an audio signature for a component of a dishwashing appliance.
Figure 6:
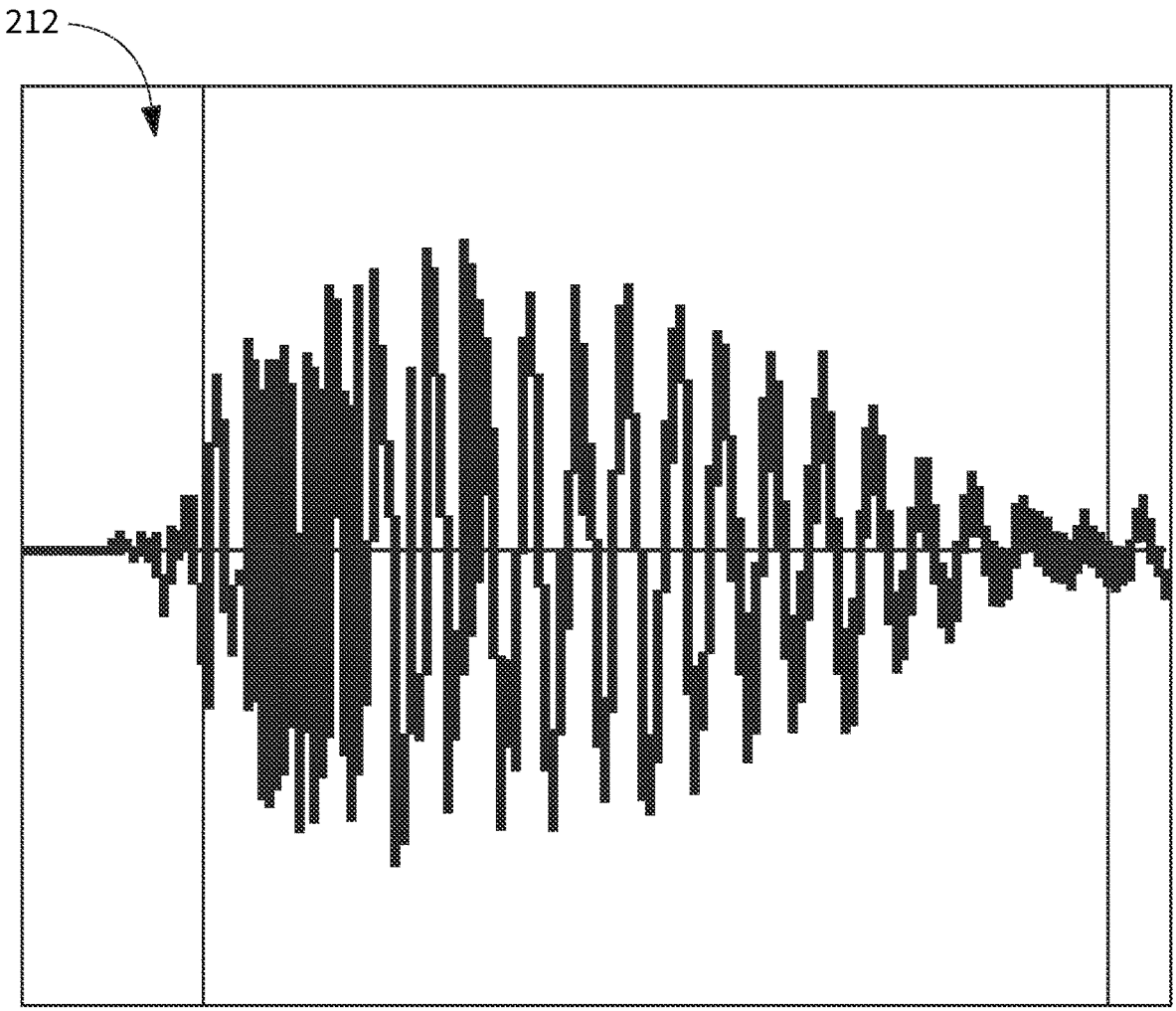
FIG. 6 illustrates another exemplary graph of an audio signature for a component of a dishwashing appliance.

FIG. 5 illustrates a first audio graph 210 of an audio signature of a first component of a dishwashing appliance such as dishwashing appliance 100, and FIG. 6 illustrates a second audio graph 212 of an audio signature of a second component of the dishwashing appliance. The first and second components may be any component of the dishwashing appliance, such as the drain pump 168, circulation pump 152, heating element 185, first relay 204, or second relay 206. For example, the first audio signature illustrated in FIG. 5 may be a sound, such as a click, when the first relay 204 engages, and the second audio signature illustrated in FIG. 6 may be a sound, e.g., click, when the second relay 206 engages.

Accordingly, a status of one or more components, such as engagement of one or both relays 204 and 206, may be monitored or detected using the microphone 202, such as based on the presence or absence of the audio signature(s), and/or based on the timing of the audio signatures, e.g., relative to an operation or cycle of the dishwashing appliance. For example, the cycle of the dishwashing appliance may include a point in time at which the heating element, e.g., heating element 184, is expected to activate. Thus, detecting the engagement of an associated relay based on the audio signature of the relay associated with (e.g., electrically connected to) the heating element at the point in time at which the heating element is expected to activate may indicate the dishwashing appliance is performing as expected. In other instances, not detecting the audio signature of the relay associated with the heating element at the point in time at which the heating element is expected to activate or detecting the audio signature of the relay associated with the heating element at a point in time during the cycle other than the point in time at which the heating element is expected to activate may indicate the dishwashing appliance is performing at a less than optimal level. For example, such sub-optimal performance may include not cleaning dishes effectively, e.g., because the water is not heated sufficiently, such as less than a temperature setpoint for the cycle, or not drying the dishes effectively, etc. Moreover, determining that the heating element did not activate or that the heating element deactivated early may advantageously permit detecting the sub-optimal performance sooner, e.g., before a user opens the dishwashing appliance after the cycle and discovers dishes that were not fully washed or dried or otherwise not treated as expected during the cycle of the dishwashing appliance. The heating element not activating may be determined e.g., because the audio signature of the associated relay was not detected when expected, and the heating element deactivating prematurely, e.g., prior to the predetermined activation time duration elapsing, may be determined because the audio signature of the associated relay was detected when not expected. Such early detection, e.g., during the cycle rather than after the cycle has completed, may advantageously permit the dishwashing appliance to take one or more remedial actions, such as boosting a voltage supplied to the relay to engage the relay and thereby prevent or reduce the sub-optimal performance.

Additionally, as may be seen, e.g., in FIGS. 5 and 6, each component may have a unique audio signature. Thus, some exemplary embodiments of the present disclosure may include detecting audio feedback from one or more components and also identifying or recognizing which component generated the detected audio feedback based on differentiating the audio signature of one component from the audio signature of another component.

The cycle of the dishwashing appliance during which audio feedback is monitored and processed may be any operation cycle of the dishwashing appliance, e.g., a wash cycle such as "normal," "eco," "power wash," or various other similar wash cycles, or the cycle may be a rinse only cycle or a drying cycle, etc. Additionally, the cycle of the dishwashing appliance during which audio feedback is monitored and processed may be a diagnostic cycle, such as a shortened cycle with specific operating parameters for one or more components of the dishwashing appliance designed for testing and/or monitoring one or more components of the dishwashing appliance, whereby issues or potential faults with one or more components of the dishwashing appliance may be detected before they can impact wash performance.

Figure 7:
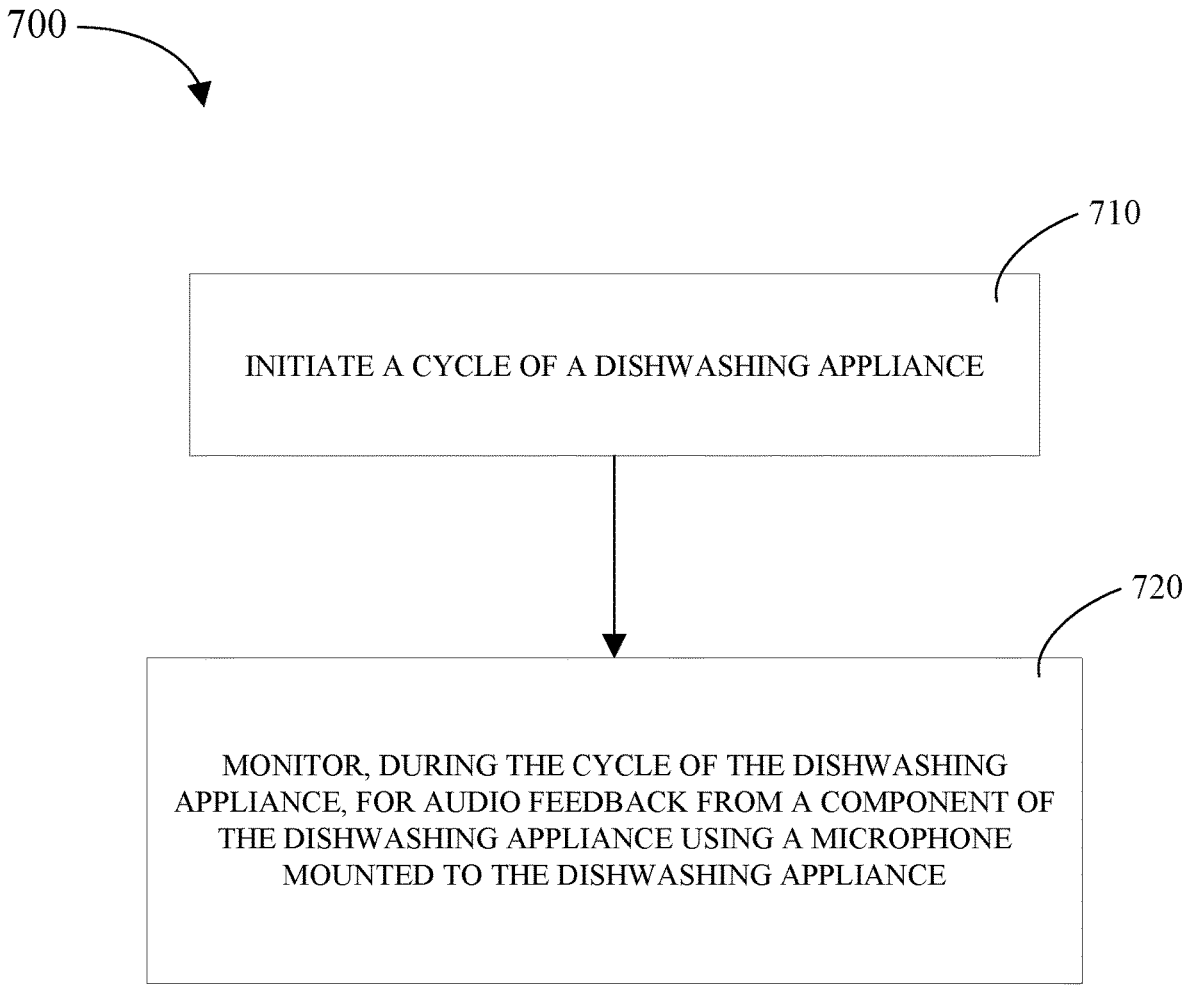
FIG. 7 provides a flow diagram of an exemplary method of operating a dishwashing appliance according to one or more embodiments of the present disclosure.

Turning now to FIG. 7, embodiments of the present disclosure may also include methods of operating a dishwashing appliance, such as the exemplary method 700 illustrated in FIG. 7. For example, such methods may be used with dishwashing appliance 100, but are not limited to this particular dishwashing appliances. Accordingly, it is to be understood that reference numerals for dishwashing appliance 100 and components thereof are included in the description of method 700 solely for purposes of illustration and by way of example only.

As illustrated at 710 in FIG. 7, method 700 may include initiating a cycle of the dishwashing appliance. For example, the cycle of the dishwashing appliance may be a wash cycle, a rinse only cycle, a diagnostic cycle, or other cycle of the dishwashing appliance. Initiating the cycle of the dishwashing appliance includes activating at least one mechanical component, e.g., causing at least one mechanical component of the dishwashing appliance to be operated. For example, the mechanical component may be a motor, a heating element, a pump, or a valve, among other possible example mechanical components of a dishwashing appliance. Also, operating the mechanical component includes changing a physical status of the component, e.g., a speed, position, etc. of the component, such as accelerating the motor, fan, etc., e.g., from a zero starting speed, opening a valve, and/or other changes in the physical state of one or more mechanical components of the dishwashing appliance.

Also as illustrated in FIG. 7, e.g., at 720, method 700 may further include monitoring for audio feedback from a component of the dishwashing appliance. Such monitoring may be performed during the cycle of the dishwashing appliance, such as throughout the entire cycle or at certain points in time during the cycle when a change in state of a component, e.g., engagement of a relay, is expected. Monitoring for the audio feedback, e.g., an audio signature of the component, may be carried out using a microphone, such as microphone 202 described above, mounted to the dishwashing appliance, e.g., mounted outside of the wash chamber.

In some embodiments, method 700 may further include recording a baseline sound of the component prior to initiating the cycle of the dishwashing appliance. The baseline sound may be recorded, e.g., in a factory prior to shipping the dishwashing appliance, or may be recorded after installation and commissioning of the dishwashing appliance. The baseline sound may be a single sound, or may be an average or composite of multiple sounds. For example, an audio signature of a component may be recorded over multiple cycles and the baseline sound may be derived from a composite or average of the recording from the multiple cycles, such as the first ten cycles of the dishwashing appliance. Such methods may also include storing the baseline sound of the component in a memory. For example, the baseline sound may be stored in a memory of a controller of the dishwashing appliance. The baseline sound may also or instead be stored remotely, such as in a remote computing device, e.g., server or database, with which the dishwashing appliance communicates, such as via the internet. For example, such remote storage may include storing the baseline sound in a memory of a remote computing device which is a part of a distributed computing environment, such as the cloud or the edge. Exemplary methods may also include comparing the audio feedback from the component of the dishwashing appliance during the cycle to the stored baseline sound. For example, the baseline sound may be a "healthy" sound, e.g., when the component and/or the dishwashing appliance as a whole are operating as expected and/or optimally, and when the audio feedback during the cycle deviates from the baseline sound, a potential issue with the component may be indicated by such deviation.

For example, method 700 may, in some embodiments, further include determining, based on comparing the audio feedback from the component of the dishwashing appliance during the cycle to the stored baseline sound, that the audio feedback differs from the stored baseline sound by at least a fault threshold. In such embodiments, one or more corrective or remedial actions may be implemented, such as generating a fault code in response to determining the audio feedback differs from the stored baseline sound by at least a fault threshold.

The component in method 700 may, in some embodiments, be an electrical relay. For example, in some such embodiments where the component is an electrical relay, the electrical relay may be a first electrical relay, and the dishwashing appliance may further include a second electrical relay. In such embodiments, monitoring for audio feedback from the component of the dishwashing appliance during the cycle of the dishwashing appliance may include monitoring for audio feedback from one or both of the first electrical relay and the second electrical relay.

As another example, in some embodiments where the component is an electrical relay, the audio feedback may be or may include an engagement sound, such as the sound the electrical relay generates when the electrical relay engages. Such embodiments may further include detecting the engagement sound while monitoring for audio feedback during the cycle at an unexpected time. Detecting the engagement sound at the unexpected time may, for example, indicate that the relay disengaged and is then re-engaging at the unexpected time. Such embodiments may further include generating a fault code in response to detecting the engagement sound at the unexpected time and/or boosting a supplied voltage to the electrical relay in response to detecting the engagement sound at the unexpected time. Such embodiments may also or instead include not detecting the engagement sound while monitoring for audio feedback during the cycle at a point in time during the cycle when the engagement sound is expected, e.g., the audio feedback may be or may include an absence of the engagement sound at the expected time. When the audio feedback includes not detecting the engagement sound at a point in time during the cycle when the engagement sound is expected, a fault code may be generated and/or a voltage supplied to the electrical relay may be boosted.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they include structural elements that do not differ from the literal language of the claims, or if they include equivalent structural elements with insubstantial differences from the literal languages of the claims.

What is claimed is:

1. A method of operating a dishwashing appliance, the dishwashing appliance comprising a tub defining a wash chamber therein for receipt of articles for washing, the method comprising:

initiating a cycle of the dishwashing appliance; and monitoring, during the cycle of the dishwashing appliance, audio feedback from a component of the dishwashing appliance using a microphone mounted to the dishwashing appliance outside of the wash chamber, wherein the microphone is mounted to an outer surface of a sump of the dishwashing appliance, and wherein the component comprises an electrical relay coupled to a heating element of the dishwashing appliance.

2. The method of claim 1, further comprising recording a baseline sound of the component prior to initiating the cycle of the dishwashing appliance, storing the baseline sound of the component in a memory, and comparing the audio feedback from the component of the dishwashing appliance during the cycle to the stored baseline sound.

3. The method of claim 2, further comprising determining, based on comparing the audio feedback from the component of the dishwashing appliance during the cycle to the stored baseline sound, that the audio feedback differs from the stored baseline sound by at least a fault threshold, and generating a fault code in response to determining the audio feedback differs from the stored baseline sound by at least a fault threshold.

4. The method of claim 1, wherein the electrical relay is a first electrical relay, wherein the dishwashing appliance further comprises a second electrical relay, and wherein monitoring, during the cycle of the dishwashing appliance, audio feedback from the component of the dishwashing appliance comprises monitoring audio feedback from the first electrical relay and the second electrical relay.

5. The method of claim 1, wherein the audio feedback comprises an engagement sound when the electrical relay engages.

6. The method of claim 5, further comprising detecting the engagement sound while monitoring audio feedback during the cycle at an unexpected time.

7. The method of claim 6, further comprising boosting a supplied voltage to the electrical relay in response to detecting the engagement sound at the unexpected time.

8. The method of claim 5, wherein the audio feedback comprises not detecting the engagement sound while monitoring audio feedback during the cycle, at a point in time during the cycle when the engagement sound is expected.

9. The method of claim 8, further comprising boosting a supplied voltage to the electrical relay in response to not detecting the engagement sound at the point in time during the cycle when the engagement sound is expected.

10. A dishwashing appliance, comprising:

a tub defining a wash chamber therein for receipt of articles for washing;

a microphone mounted to the dishwashing appliance outside of the wash chamber, wherein the microphone is mounted to an outer surface of a sump of the dishwashing appliance; and a controller, the controller configured for:

initiating a cycle of the dishwashing appliance; and monitoring, during the cycle of the dishwashing appliance, audio feedback from a component of the dishwashing appliance using the microphone, wherein the component comprises an electrical relay coupled to a heating element of the dishwashing appliance.

11. The dishwashing appliance of claim 10, wherein the controller is further configured for recording a baseline sound of the component prior to initiating the cycle of the dishwashing appliance, storing the baseline sound of the component in a memory, and comparing the audio feedback from the component of the dishwashing appliance during the cycle to the stored baseline sound.

12. The dishwashing appliance of claim 11, wherein the controller is further configured for determining, based on comparing the audio feedback from the component of the dishwashing appliance during the cycle to the stored baseline sound, that the audio feedback differs from the stored baseline sound by at least a fault threshold, and generating a fault code in response to determining the audio feedback differs from the stored baseline sound by at least a fault threshold.

13. The dishwashing appliance of claim 10, wherein the electrical relay is a first electrical relay, further comprising a second electrical relay, and wherein monitoring, during the cycle of the dishwashing appliance, audio feedback from the component of the dishwashing appliance comprises monitoring audio feedback from the first electrical relay and the second electrical relay.

14. The dishwashing appliance of claim 10, wherein the audio feedback comprises an engagement sound when the electrical relay engages.

15. The dishwashing appliance of claim 14, wherein the controller is further configured for detecting the engagement sound while monitoring audio feedback during the cycle at an unexpected time.

16. The dishwashing appliance of claim 15, wherein the controller is further configured for boosting a supplied voltage in response to detecting the engagement sound at the unexpected time.

17. The dishwashing appliance of claim 14, wherein the audio feedback comprises not detecting the engagement sound while monitoring audio feedback during the cycle, at a point in time during the cycle when the engagement sound is expected.

18. The dishwashing appliance of claim 17, wherein the controller is further configured for boosting a supplied voltage in response to not detecting the engagement sound at the point in time during the cycle when the engagement sound is expected.

* * * * *